US010763626B1

(12) United States Patent
Yang et al.

(10) Patent No.: US 10,763,626 B1
(45) Date of Patent: Sep. 1, 2020

(54) UNIVERSAL SERIAL BUS CONNECTOR

(71) Applicant: Cheng Uei Precision Industry Co., LTD., New Taipei (TW)

(72) Inventors: Cheng-Wang Yang, Dong-Guan (CN); Yan Sun, Dong-Guan (CN); Hsin-Min Chao, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/565,473

(22) Filed: Sep. 9, 2019

(30) Foreign Application Priority Data

Mar. 27, 2019 (CN) ..... 2019 2 0406227 U

(51) Int. Cl.

| | |
|---|---|
| ***H01R 24/62*** | (2011.01) |
| ***H01R 13/506*** | (2006.01) |
| ***H01R 13/26*** | (2006.01) |
| ***H01R 13/502*** | (2006.01) |
| ***H01R 13/405*** | (2006.01) |
| ***H01R 107/00*** | (2006.01) |

(52) U.S. Cl.
CPC ..... *H01R 24/62* (2013.01); *H01R 13/26* (2013.01); *H01R 13/405* (2013.01); *H01R 13/506* (2013.01); *H01R 13/5025* (2013.01); *H01R 2107/00* (2013.01)

(58) Field of Classification Search
CPC ..... H01R 24/60; H01R 2107/00; H01R 13/6585; H01R 13/405; H01R 13/6581; H01R 13/504; H01R 13/5202; H01R 13/6471; H01R 13/6594; H01R 43/24; H01R 13/506; H01R 13/631; H01R 13/6582; H01R 12/707; H01R 13/04; H01R 13/5216; H01R 13/6273; H01R 13/64; H01R 13/646; H01R 13/652; H01R 13/6586; H01R 13/6593; H01R 13/6595; H01R 13/6596; H01R 13/6597; H01R 13/6658; H01R 43/005; H01R 43/205
See application file for complete search history.

(56) References Cited

U.S. PATENT DOCUMENTS

| | | | | |
|---|---|---|---|---|
| 10,103,491 | B2 * | 10/2018 | Ju | H01R 13/04 |
| 10,177,512 | B2 * | 1/2019 | Zhao | H01R 13/6471 |
| 10,211,563 | B2 * | 2/2019 | Zhao | H01R 12/724 |
| 10,211,580 | B2 * | 2/2019 | Zhao | H01R 13/04 |

(Continued)

*Primary Examiner* — Edwin A. Leon
*Assistant Examiner* — Matthew T Dzierzynski
(74) *Attorney, Agent, or Firm* — Cheng-Ju Chiang

(57) ABSTRACT

A universal serial bus connector includes an insulating housing, a terminal module and an outer shell. The insulating housing has a base body which opens an accommodating space. A rear wall of the accommodating space protrudes frontward to form a tongue portion. The tongue portion opens a receiving space. The terminal module is received in the receiving space. The terminal module includes a main body, and a plurality of terminals molded in the main body. Each terminal has a base portion, a contact portion connected with a front end of the base portion, and a soldering portion connected with a rear end of the base portion. The contact portion and the soldering portion of each terminal are disposed to two opposite ends of the insulating housing. The base portion of each terminal is mounted in the main body. The outer shell is assembled to the insulating housing.

16 Claims, 5 Drawing Sheets

(56) References Cited

U.S. PATENT DOCUMENTS

| | | | | |
|---|---|---|---|---|
| 10,236,632 | B2 * | 3/2019 | Zhang | H01R 24/60 |
| 10,305,227 | B2 * | 5/2019 | Wang | H01R 13/6595 |
| 10,305,229 | B2 * | 5/2019 | Zhao | H01R 13/6597 |
| 10,367,320 | B2 * | 7/2019 | Cheng | G02B 6/4284 |
| 10,468,808 | B2 * | 11/2019 | Duan | H01R 13/6583 |
| 10,468,831 | B2 * | 11/2019 | Zhao | H01R 13/64 |
| 10,505,307 | B2 * | 12/2019 | Shah | H01R 13/504 |
| 10,574,003 | B2 * | 2/2020 | Cheng | H01R 13/6585 |
| 10,680,387 | B2 * | 6/2020 | Cheng | H01R 13/405 |

* cited by examiner

UNIVERSAL SERIAL BUS CONNECTOR

CROSS-REFERENCE TO RELATED APPLICATION

The present application is based on, and claims priority from, China Patent Application No. 201920406227.4, filed Mar. 27, 2019, the disclosure of which is hereby incorporated by reference herein in its entirety.

BACKGROUND OF THE INVENTION

1. Field of the Invention

The present invention generally relates to a universal serial bus connector, and more particularly to a universal serial bus connector preventing a terminal thereof from being deformed, and the terminal is assembled to the universal serial bus connector relatively more stably.

2. The Related Art

Usually, a conventional universal serial bus connector is used for specifying a connection and a communication between a computer and an external equipment. Nowadays, electronic information technologies are altered from day to day, extensive usages of electronic phones and other digital products makes the universal serial bus connectors become standard configurations of most of the digital products.

However, in a process of the conventional universal serial bus connector, contact terminals are directly assembled to the conventional universal serial bus connector, it is difficult to distinguish that an assembly of the contact terminals is normal or not and a height between the contact terminals and a main body of the conventional universal serial bus connector is consistent or not, in that case, a yield of manufacturing the conventional universal serial bus connector is lowered. Furthermore, soldering portions extended from the contact terminals are perpendicular to the contact terminals and are exposed out of a shell of the conventional universal serial bus connector, a thickness of a circuit board of the conventional universal serial bus connector is hardly buffered, and then the contact terminals are caused to be deformed or damaged, or because an accidental collision of the conventional universal serial bus connector, deformations of the contact terminals are caused in the assembling process of the conventional universal serial bus connector. In addition, when an elastic piece for assisting the conventional universal serial bus connector to be inserted into or withdrawn from a docking port is pushed by an external force, the elastic piece will abut against a tongue portion of the conventional universal serial bus connector, a contact-type insertion-withdrawal force between the conventional universal serial bus connector and the docking port is unstable.

SUMMARY OF THE INVENTION

An object of the present invention is to provide a universal serial bus connector. The universal serial bus connector includes an insulating housing, a terminal module and an outer shell. The insulating housing has a base body which opens an accommodating space penetrating through a front surface of the base body. A front surface of a rear wall of the accommodating space protrudes frontward to form a tongue portion projecting beyond the front surface of the base body. A middle of the tongue portion opens a receiving space penetrating rearward through a rear surface of the insulating housing. A top of the tongue portion opens a plurality of openings penetrating through the top of the tongue portion. The plurality of the openings are communicated between the accommodating space and the receiving space. The terminal module is received in the receiving space of the tongue portion. The terminal module includes a main body, and a plurality of terminals molded in the main body. Each terminal has a base portion, a contact portion connected with a front end of the base portion, and a soldering portion connected with a rear end of the base portion. The contact portion and the soldering portion of each terminal are disposed to two opposite ends of the insulating housing. The base portion of each terminal is mounted in the main body. The contact portion of each terminal is exposed beyond a top surface of the main body. The contact portion of each terminal is exposed out of the tongue portion through one of the plurality of the openings. The soldering portion of each terminal projects beyond a rear surface of the main body. The outer shell is assembled to the insulating housing, and surrounds the soldering portion of each terminal.

Another object of the present invention is to provide a universal serial bus connector. The universal serial bus connector includes an insulating housing, a terminal module, a resilient shell and an outer shell. The insulating housing has an accommodating space penetrating through a front surface of the insulating housing. A front surface of a rear wall of the accommodating space protrudes frontward to form a tongue portion. The tongue portion opens a receiving space penetrating rearward through a rear surface of the insulating housing. A top of the tongue portion opens a plurality of openings penetrating through the top of the tongue portion. The plurality of the openings are communicated between the accommodating space and the receiving space. The terminal module is received in the receiving space of the tongue portion. The terminal module includes a main body, and a plurality of terminals molded in the main body. Each terminal has a base portion mounted in the main body, a contact portion connected with a front end of the base portion, and a soldering portion connected with a rear end of the base portion. The contact portion of each terminal is exposed beyond a top surface of the main body. The contact portion of each terminal is exposed out of the tongue portion through one of the plurality of the openings. The soldering portion of each terminal projects beyond a rear surface of the main body. The resilient shell is mounted to a top surface and a bottom surface of the insulating housing. The outer shell surrounds the insulating housing.

Another object of the present invention is to provide a universal serial bus connector. The universal serial bus connector includes an insulating housing, a terminal module, two elastic pieces and an outer shell. The insulating housing has an accommodating space penetrating through a front surface of the insulating housing. A front surface of a rear wall of the accommodating space protrudes frontward to form a tongue portion. The tongue portion opens a receiving space penetrating rearward through a rear surface of the insulating housing. A top of the tongue portion opens a plurality of openings penetrating through the top of the tongue portion. The plurality of the openings are communicated between the accommodating space and the receiving space. The terminal module is received in the receiving space of the tongue portion. The terminal module includes a main body, and a plurality of terminals molded in the main body. Each terminal has a base portion mounted in the main body, a contact portion connected with a front end of the base portion, and a soldering portion connected with a rear end of the base portion. The contact portion of each terminal is exposed beyond a top surface of the main body. The contact portion of each terminal is exposed out of the tongue portion through one of the plurality of the openings. The soldering portion of each terminal projects beyond a rear surface of the main body. The two elastic pieces are mounted in two opposite sides of the insulating housing. The terminal module is located between the two elastic pieces. The outer shell surrounds the insulating housing.

As described above, the middle of the tongue portion opens the receiving space extending rearward and penetrating rearward through the rear surface of the insulating housing, a top surface of the tongue portion opens at least one first opening and at least one second opening located in front of the at least one first opening, the contact portion of each terminal is exposed out of the tongue portion through the at least one first opening and the at least one second opening, so the universal serial bus connector prevents each terminal of the universal serial bus connector from being deformed and each terminal is assembled to the universal serial bus connector relatively more stably.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
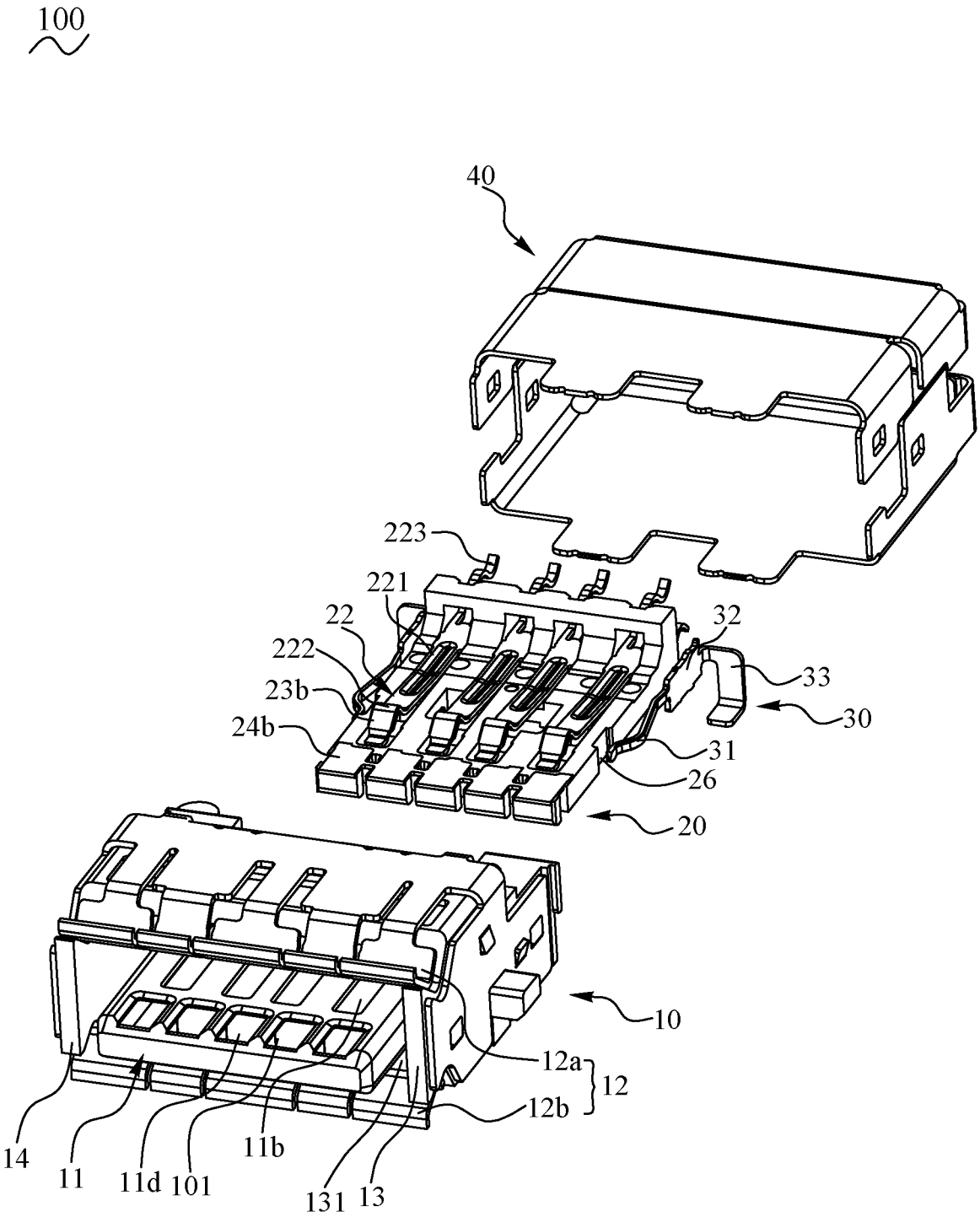
FIG. 1 is an exploded view of a universal serial bus connector in accordance with a preferred embodiment of the present invention.
Figure 2:
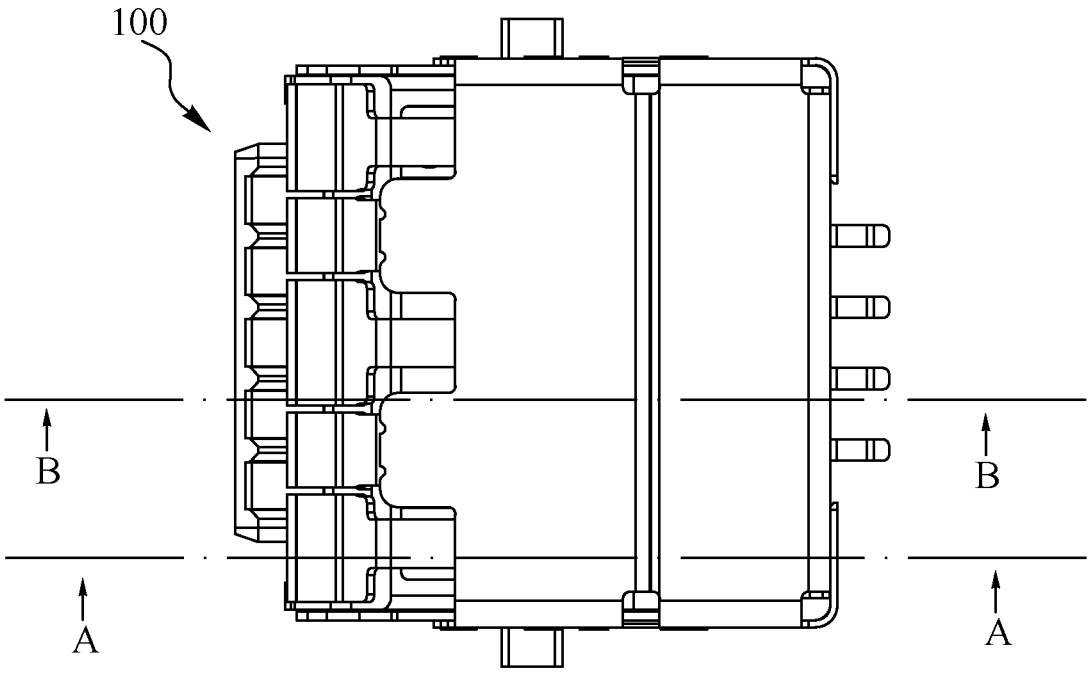
FIG. 2 is a vertical view of the universal serial bus connector of FIG. 1.
Figure 3:
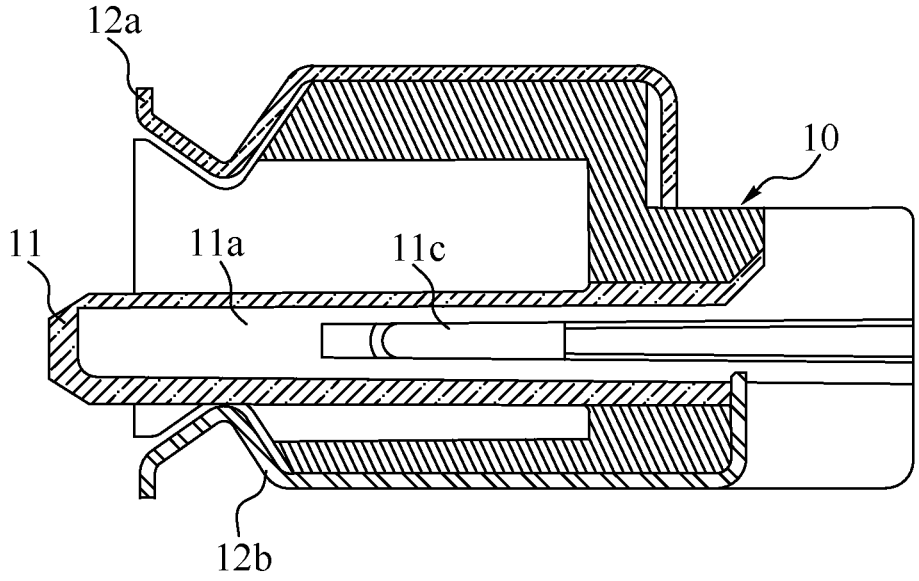
FIG. 3 is a sectional view of the universal serial bus connector along a line B-B of FIG. 2.

With reference to FIG. 1 to FIG. 3, a universal serial bus connector 100 in accordance with a preferred embodiment of the present invention is shown. The universal serial bus connector 100 includes an insulating housing 10, a terminal module 20 and an outer shell 40.

Referring to FIG. 1 to FIG. 3, the insulating housing 10 has an accommodating space 131 penetrating through a front surface of the insulating housing 10. The insulating housing 10 has a base body 13. The base body 13 opens the accommodating space 131 penetrating through a front surface of the base body 13. A middle of a front surface of a rear wall of the accommodating space 131 protrudes frontward to form a tongue portion 11. The tongue portion 11 is used for connecting with a corresponding docking port. The insulating housing 10 is equipped with a resilient shell 12. The resilient shell 12 is used for assisting the insulating housing 10 to be inserted into or withdrawal from the corresponding docking port and sharing a stress of the insulating housing 10 in use. A middle of the tongue portion 11 opens a receiving space 11*a* extending rearward and penetrating rearward through a rear surface of the insulating housing 10. Two opposite sides of the tongue portion 11 open two connecting holes 11*c* penetrating through two side surfaces of the two opposite sides of the tongue portion 11, respectively. The two connecting holes 11*c* are communicated between the receiving space 11*a* and an external space. Specifically, the two connecting holes 11*c* are communicated between the receiving space 11*a* and the accommodating space 131.

A top of the tongue portion 11 opens a plurality of openings 101 penetrating through the top of the tongue portion 11. The plurality of the openings 101 are communicated between the accommodating space 131 and the receiving space 11*a*. The plurality of the openings 101 are communicated with an external space through the accommodating space 131. The top of the tongue portion 11 opens at least one first opening 11*b* penetrating through the top of the tongue portion 11, and at least one second opening 11*d* penetrating through the top of the tongue portion 11 and located in front of the at least one first opening 11*b*. The at least one first opening 11*b* is communicated with the receiving space 11*a*, and the at least one second opening 11*d* is communicated with the receiving space 11*a*. In another preferred embodiment, the top of the tongue portion 11 opens a plurality of first openings 11*b* arranged transversely, and a plurality of second openings 11*d* arranged transversely. The plurality of the first openings 11*b* and the plurality of the second openings 11*d* are arranged in two rows. The plurality of the first openings 11*b* and the plurality of the second openings 11*d* penetrate through the top of the tongue portion 11. The plurality of the first openings 11*b* and the plurality of the second openings 11*d* are communicated between the accommodating space 131 and the receiving space 11*a*. The plurality of the first openings 11*b* and the plurality of the second openings 11*d* are communicated with the external space through the accommodating space 131. The plurality of the first openings 11*b* are located behind the plurality of the second openings 11*d*. The receiving space 11*a* is communicated with an external space through the plurality of the first openings 11*b* and the plurality of the second openings 11*d*.

A front end of the insulating housing 10 is defined as a connecting end 14. The tongue portion 11 is formed at the front end of the insulating housing 10. The resilient shell 12 is mounted to a top surface and a bottom surface of the insulating housing 10, and the resilient shell 12 is adjacent to the tongue portion 11 and the connecting end 14 corresponding to the docking port. A clamping force is exerted on the docking port through the resilient shell 12 for stabilizing a connection between the docking port and the connecting end 14. In the preferred embodiment, the resilient shell 12 includes an upper shell 12*a* mounted to the top surface of the insulating housing 10, and a lower shell 12*b* of the bottom surface of the insulating housing 10.

Referring to FIG. 1 to FIG. 4, the terminal module 20 is received in the receiving space 11*a* of the tongue portion 11. The terminal module 20 includes a main body 21, and a plurality of terminals 22 molded in the main body 21. The plurality of the terminals 22 include at least one contact terminal 23 and at least one transmission terminal 24. The at least one contact terminal 23 is disposed to a top surface of the terminal module 20. The at least one transmission terminal 24 is molded in the main body 21 by virtue of an envelope injection technology, so a manufacturing yield of the universal serial bus connector 100 is improved. Each terminal 22 has a base portion 221, a contact portion 222 connected with a front end of the base portion 221, and a soldering portion 223 connected with a rear end of the base portion 221. Each contact terminal 23 has a first base portion 23*a*, a first contact portion 23*b* connected with a front end of the first base portion 23*a*, and a first soldering portion 23*c* connected with a rear end of the first base portion 23*a*. The contact portion 222 of each terminal 22 is exposed beyond a top surface of the main body 21. The base portion 221 of each terminal 22 is mounted in the main body 21. The contact portion 222 of each terminal 22 is exposed out of the tongue portion 11 through one of the plurality of the openings 101. The soldering portion 223 of each terminal 22 projects beyond a rear surface of the main body 21. The contact portion 222 and the soldering portion 223 of each terminal 22 are disposed to two opposite ends of the insulating housing 10. The first base portion 23*a* of the at least one contact terminal 23 is assembled to and fastened in the main body 21. The first contact portion 23*b* of the at least one contact terminal 23 is exposed beyond the top surface of the main body 21. The first contact portion 23*b* of the at least one contact terminal 23 is exposed out of the tongue portion 11 through the at least one first opening 11*b*. The first soldering portion 23*c* of the at least one contact terminal 23 projects beyond the rear surface of the main body 21. Two opposite side surfaces of the main body 21 are recessed inward to form two limiting grooves 26.

Each transmission terminal 24 has a second base portion 24*a*, a second touching portion 24*b* connected with a front end of the second base portion 24*a*, and a second soldering foot 24*c* connected with a rear end of the second base portion 24*a*. The second base portion 24*a* of the at least one transmission terminal 24 is integrally molded to the main body 21 by virtue of an injection technology. The second touching portion 24*b* of the at least one transmission terminal 24 is exposed beyond the top surface of the main body 21. The second touching portion 24*b* of the at least one transmission terminal 24 is exposed out of the tongue portion 11 through the at least one second opening 11*d* and located in front of the first contact portion 23*b* of the at least one contact terminal 23. The second soldering foot 24*c* of the at least one transmission terminal 24 projects beyond the rear surface of the main body 21. In another preferred embodiment, the plurality of the terminals 22 include a plurality of contact terminals 23 and a plurality of transmission terminals 24. The first contact portions 23*b* of the plurality of the contact terminals 23 are exposed out of the tongue portion 11 through the plurality of the first openings 11*b*. The second touching portions 24*b* of the plurality of the transmission terminals 24 are exposed out of the tongue portion 11 through the plurality of the second openings 11*d* and located in front of the first contact portions 23*b* of the plurality of the contact terminals 23.

The at least one contact terminal 23 is assembled in the main body 21. The main body 21 and the at least one contact terminal 23 are inserted into the receiving space 11*a* of the tongue portion 11, so the tongue portion 11 surrounds the main body 21 and the at least one contact terminal 23 to show a two-section assembly. That the tongue portion 11 surrounds the main body 21 and the at least one contact terminal 23 facilitates confirming whether an assembly of the at least one contact terminal 23 is normal or not, and confirming whether a height between the first contact portion 23*b* of the at least one contact terminal 23 and the main body 21 is consistent or not. If the assembly of the at least one contact terminal 23 is discovered to be abnormal or the height between the first contact portions 23*b* of the at least one contact terminal 23 and the main body 21 is inconsistent, the at least one contact terminal 23 is directly replaced, so that the manufacturing yield of the universal serial bus connector 100 is improved.

Figure 4:
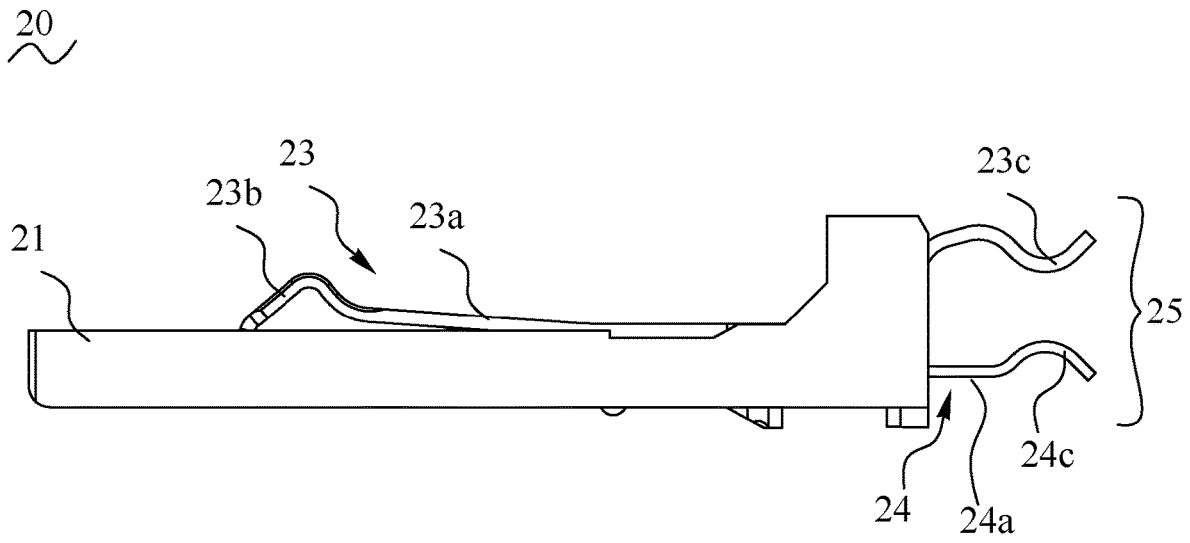
FIG. 4 is a right view of a terminal module of the universal serial bus connector of FIG. 1.
Figure 5:
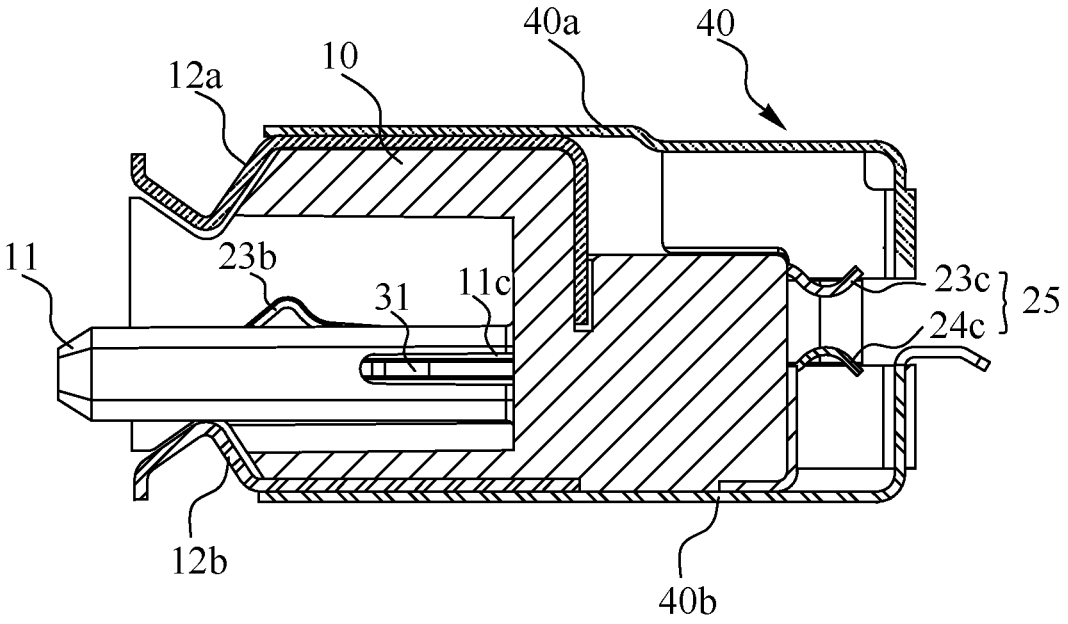
FIG. 5 is a sectional view of the universal serial bus connector along a line A-A of FIG. 2.

Referring to FIG. 4 and FIG. 5, the first soldering portion 23*c* of the at least one contact terminal 23 is soldered to and connected to a circuit board (not shown). The second soldering foot 24*c* of the at least one transmission terminal 24 is soldered to and connected to the circuit board. The first soldering portion 23*c* of the at least one contact terminal 23 and the second soldering foot 24*c* of the at least one transmission terminal 24 are exposed out of a rear end of the insulating housing 10 opposite to the front end of the insulating housing 10 where the tongue portion 11 is formed. In order to cooperate with and appropriate for the circuit boards with different thicknesses, the first soldering portion 23*c* of the at least one contact terminal 23 and the second soldering foot 24*c* of the at least one transmission terminal 24 are prevented from being deformed and damaged on account of the circuit boards with the different thicknesses. In the preferred embodiment, the first soldering portion 23*c* of the at least one contact terminal 23 is of an inverted lying S shape which is a curved structure. The first base portion 23*a* of the at least one contact terminal 23 is arched upward and then arched downward to form the first soldering portion 23*c*. A bottom surface of a tail end of the first soldering portion 23*c* is shown as a convex surface. The second soldering foot 24*c* of the at least one transmission terminal 24 is extended rearward and then arched upward from a rear end of the second base portion 24*a*. The second soldering foot 24*c* is shown as another curved structure. A top surface of a tail end of the second soldering foot 24*c* is shown as another convex surface.

The first soldering portion 23*c* of the at least one contact terminal 23 is located above and spaced from the second soldering foot 24*c* of the at least one transmission terminal 24. The tail end of the first soldering portion 23*c* of the at least one contact terminal 23 is matched with and cooperates with the tail end of the second soldering foot 24*c* of the at least one transmission terminal 24 to form a clamping structure 25 by virtue of the at least one contact terminal 23 which is the curved structure and the at least one transmission terminal 24 which is another curved structure being disposed oppositely. When the clamping structure 25 is connected with the circuit board, the clamping structure 25 clamps and fastens the circuit board between the tail end of the first soldering portion 23*c* of the at least one contact terminal 23 and the tail end of the second soldering foot 24*c* of the at least one transmission terminal 24. The thickness of the circuit board is buffered by virtue of elastic deformations of the first soldering portion 23*c* of the at least one contact terminal 23 and the second soldering foot 24*c* of the at least one transmission terminal 24 generated at the time of the first soldering portion 23*c* of the at least one contact terminal 23 and the second soldering foot 24*c* of the at least one transmission terminal 24 bearing a force, so that the plurality of the terminals 22 are prevented from being deformed and damaged.

Referring to FIG. 1, FIG. 2, FIG. 3 and FIG. 5, in order to make an insertion and withdrawal force of the universal serial bus connector 100 contacts with the docking port stabler, the receiving space 11*a* is further equipped with two elastic pieces 30. The two elastic pieces 30 are mounted in two opposite sides of the insulating housing 10. The terminal module 20 is located between the two elastic pieces 30. The two elastic pieces 30 have two insertion portions 32 extending longitudinally, two elastic portions 31 arched oppositely and then extending frontward from front ends of the two insertion portions 32, and two locating portions 33 bent oppositely, then extending downward and further bent frontward from rear ends of the two insertion portions 32. The two insertion portions 32 of the two elastic pieces 30 are inserted into the two opposite sides of the insulating housing 10. The two elastic portions 31 of the two elastic pieces 30 are exposed to the two opposite sides of the tongue portion 11 through the two connecting holes 11*c*, respectively. The two locating portions 33 of the two elastic pieces 30 are located to two opposite sides of the rear end of the insulating housing 10. When the universal serial bus connector 100 contacts the corresponding docking port, the two elastic portions 31 abut against two inner walls of the two limiting grooves 26, so the insertion and withdrawal force of the universal serial bus connector 100 is stabler by virtue of the two elastic portions 31 being pushed by an external force to abut against two inner walls of the two limiting grooves 26. When the universal serial bus connector 100 contacts the corresponding docking port, a poor contact between the universal serial bus connector 100 and the corresponding docking port is decreased on account of a sway of the universal serial bus connector 100.

Referring to FIG. 5, the outer shell 40 surrounds the insulating housing 10. The outer shell 40 is assembled to the insulating housing 10, and surrounds the soldering portion 223 of each terminal 22. The outer shell 40 surrounds the first soldering portion 23*c* of the at least one contact terminal 23 and the second soldering foot 24*c* of the at least one transmission terminal 24, a normal usage of the universal serial bus connector 100 is affected for avoiding that the first soldering portion 23*c* of the at least one contact terminal 23 and the second soldering foot 24*c* of the at least one transmission terminal 24 are deformed in a process of assembling the universal serial bus connector 100 on account of an accidental collision. In the preferred embodiment, the outer shell 40 is disposed to the rear end of the insulating housing 10 adjacent to the first soldering portion 23*c* of the at least one contact terminal 23 and the second soldering foot 24*c* of the at least one transmission terminal 24. The outer shell 40 includes a first shell 40*a* disposed to the upper shell 12*a* and the top surface of the insulating housing 10, and a second shell 40*b* disposed to the lower shell 12*b* and the bottom surface of the insulating housing 10. The first shell 40*a* covers a top surface of the first soldering portion 23*c* of the at least one contact terminal 23, and the second shell 40*b* covers a bottom surface of the second soldering foot 24*c* of the at least one transmission terminal 24.

As described above, the middle of the tongue portion 11 opens the receiving space 11*a* extending rearward and penetrating rearward through the rear surface of the insulating housing 10, the top surface of the tongue portion 11 opens the at least one first opening 11*b* and the at least one second opening 11*d* located in front of the at least one first opening 11*b*, the contact portion 222 of each terminal 22 is exposed out of the tongue portion 11 through the at least one first opening 11*b* and the at least one second opening 11*d*, so the universal serial bus connector 100 prevents each terminal 22 of the universal serial bus connector 100 from being deformed and each terminal 22 is assembled to the universal serial bus connector 100 relatively more stably.

What is claimed is:

1. A universal serial bus connector, comprising:

an insulating housing having a base body which opens an accommodating space penetrating through a front surface of the base body, a front surface of a rear wall of the accommodating space protruding frontward to form a tongue portion projecting beyond the front surface of the base body, a middle of the tongue portion opening a receiving space penetrating rearward through a rear surface of the insulating housing, a top of the tongue portion opening a plurality of openings penetrating through the top of the tongue portion, the plurality of the openings being communicated between the accommodating space and the receiving space;

a terminal module received in the receiving space of the tongue portion, the terminal module including a main body, and a plurality of terminals molded in the main body, each terminal having a base portion, a contact portion connected with a front end of the base portion, and a soldering portion connected with a rear end of the base portion, the contact portion and the soldering portion of each terminal being disposed to two opposite ends of the insulating housing, the base portion of each terminal being mounted in the main body, the contact portion of each terminal being exposed beyond a top surface of the main body, the contact portion of each terminal being exposed out of the tongue portion through one of the plurality of the openings, the soldering portion of each terminal projecting beyond a rear surface of the main body; and an outer shell assembled to the insulating housing, and surrounding the soldering portion of each terminal.

2. The universal serial bus connector as claimed in claim 1, wherein the receiving space is further equipped with two elastic pieces, the two elastic pieces are mounted to two opposite sides of the insulating housing, the terminal module is located between the two elastic pieces, the two elastic pieces have two insertion portions extending longitudinally and inserted into the two opposite sides of the insulating housing, and two elastic portions arched oppositely and then extending frontward from front ends of the two insertion portions, two opposite sides of the tongue portion open two connecting holes penetrating through two side surfaces of the two opposite sides of the tongue portion, respectively, the two connecting holes are communicated between the receiving space and an external space, the two elastic portions of the two elastic pieces are exposed to the two opposite sides of the tongue portion through the two connecting holes, respectively.

3. The universal serial bus connector as claimed in claim 2, wherein two opposite side surfaces of the main body are recessed inward to form two limiting grooves, the two elastic portions abut against two inner walls of the two limiting grooves.

4. The universal serial bus connector as claimed in claim 2, wherein the two elastic pieces have two locating portions bent oppositely, then extending downward and further bent frontward from rear ends of the two insertion portions, the two locating portions of the two elastic pieces are located to two opposite sides of a rear end of the insulating housing.

5. The universal serial bus connector as claimed in claim 1, wherein the plurality of the terminals include at least one contact terminal, the at least one contact terminal is disposed to a top surface of the terminal module.

6. The universal serial bus connector as claimed in claim 5, wherein each contact terminal has a first base portion, a first contact portion connected with a front end of the first base portion, and a first soldering portion connected with a rear end of the first base portion, the first base portion of the at least one contact terminal is assembled to and fastened in the main body, the first contact portion of the at least one contact terminal is exposed beyond the top surface of the main body, the top of the tongue portion opens at least one first opening penetrating through the top of the tongue portion, the at least one first opening is communicated with the receiving space, the first contact portion of the at least one contact terminal is exposed out of the tongue portion through the at least one first opening, the first soldering portion of the at least one contact terminal projects beyond the rear surface of the main body.

7. The universal serial bus connector as claimed in claim 6, wherein the plurality of the terminals include at least one transmission terminal, the at least one transmission terminal is molded in the main body.

8. The universal serial bus connector as claimed in claim 7, wherein each transmission terminal has a second base portion, a second touching portion connected with a front end of the second base portion, and a second soldering foot connected with a rear end of the second base portion, the second base portion of the at least one transmission terminal is integrally molded to the main body, the second touching portion of the at least one transmission terminal is exposed beyond the top surface of the main body, the top of the tongue portion opens at least one second opening penetrating through the top of the tongue portion and located in front of the at least one first opening, the at least one second opening is communicated with the receiving space, the second touching portion of the at least one transmission terminal is exposed out of the tongue portion through the at least one second opening and located in front of the first contact portion of the at least one contact terminal, the second soldering foot of the at least one transmission terminal projects beyond the rear surface of the main body.

9. The universal serial bus connector as claimed in claim 8, wherein the first soldering portion of the at least one contact terminal is of an inverted lying S shape which is a curved structure, the first base portion of the at least one contact terminal is arched upward and then arched downward to form the first soldering portion, a bottom surface of a tail end of the first soldering portion is shown as a convex surface.

10. The universal serial bus connector as claimed in claim 8, wherein the second soldering foot of the at least one transmission terminal is extended rearward and then arched upward from a rear end of the second base portion, the second soldering foot is shown as another curved structure, a top surface of a tail end of the second soldering foot is shown as another convex surface.

11. The universal serial bus connector as claimed in claim 1, wherein the top of the tongue portion opens a plurality of first openings arranged transversely, and a plurality of second openings arranged transversely, the plurality of the first openings and the plurality of the second openings are arranged in two rows, the plurality of the first openings and the plurality of the second openings penetrate through the top of the tongue portion, the plurality of the first openings and the plurality of the second openings are communicated between the accommodating space and the receiving space, the plurality of the first openings are located behind the plurality of the second openings, each contact terminal has a first contact portion, each transmission terminal has a second touching portion, the first contact portions of the plurality of the contact terminals are exposed out of the tongue portion through the plurality of the first openings, the second touching portions of the plurality of the transmission terminals are exposed out of the tongue portion through the plurality of the second openings and located in front of the first contact portions of the plurality of the contact terminals.

12. The universal serial bus connector as claimed in claim 11, wherein the plurality of the first openings and the plurality of the second openings are communicated with an external space through the accommodating space, the receiving space is communicated with the external space through the plurality of the first openings and the plurality of the second openings.

13. The universal serial bus connector as claimed in claim 1, wherein the plurality of the openings are communicated with an external space through the accommodating space.

14. The universal serial bus connector as claimed in claim 1, wherein the insulating housing is equipped with a resilient shell, the resilient shell is mounted to a top surface and a bottom surface of the insulating housing.

15. A universal serial bus connector, comprising:

an insulating housing having an accommodating space penetrating through a front surface of the insulating housing, a front surface of a rear wall of the accommodating space protruding frontward to form a tongue portion, the tongue portion opening a receiving space penetrating rearward through a rear surface of the insulating housing, a top of the tongue portion opening a plurality of openings penetrating through the top of the tongue portion, the plurality of the openings being communicated between the accommodating space and the receiving space;

a terminal module received in the receiving space of the tongue portion, the terminal module including a main body, and a plurality of terminals molded in the main body, each terminal having a base portion mounted in the main body, a contact portion connected with a front end of the base portion, and a soldering portion connected with a rear end of the base portion, the contact portion of each terminal being exposed beyond a top surface of the main body, the contact portion of each terminal being exposed out of the tongue portion through one of the plurality of the openings, the soldering portion of each terminal projecting beyond a rear surface of the main body;

a resilient shell mounted to a top surface and a bottom surface of the insulating housing; and an outer shell surrounding the insulating housing.

16. A universal serial bus connector, comprising:

an insulating housing having an accommodating space penetrating through a front surface of the insulating housing, a front surface of a rear wall of the accommodating space protruding frontward to form a tongue portion, the tongue portion opening a receiving space penetrating rearward through a rear surface of the insulating housing, a top of the tongue portion opening a plurality of openings penetrating through the top of the tongue portion, the plurality of the openings being communicated between the accommodating space and the receiving space;

a terminal module received in the receiving space of the tongue portion, the terminal module including a main body, and a plurality of terminals molded in the main body, each terminal having a base portion mounted in the main body, a contact portion connected with a front end of the base portion, and a soldering portion connected with a rear end of the base portion, the contact portion of each terminal being exposed beyond a top surface of the main body, the contact portion of each terminal being exposed out of the tongue portion through one of the plurality of the openings, the soldering portion of each terminal projecting beyond a rear surface of the main body;

two elastic pieces mounted in two opposite sides of the insulating housing, the terminal module being located between the two elastic pieces; and an outer shell surrounding the insulating housing.

* * * * *